US007909674B2

(12) United States Patent
Goozner

(10) Patent No.: US 7,909,674 B2
(45) Date of Patent: Mar. 22, 2011

(54) ILLUMINATED DREIDEL

(76) Inventor: Raphael Goozner, Charlotte, NC (US)

( * ) Notice: Subject to any disclaimer, the term of this patent is extended or adjusted under 35 U.S.C. 154(b) by 57 days.

(21) Appl. No.: 12/292,058

(22) Filed: Nov. 12, 2008

(65) Prior Publication Data

US 2010/0120324 A1 May 13, 2010

(51) Int. Cl.
*A63H 1/24* (2006.01)

(52) U.S. Cl. ..... 446/242; 446/236; 446/243; 446/256; 446/264; 446/484; 362/253; 200/61.1

(58) Field of Classification Search ..... 446/242, 446/256, 233, 236, 243, 258, 484, 264; 362/253; 200/61.1
See application file for complete search history.

(56) References Cited

U.S. PATENT DOCUMENTS

| | | | | |
|---|---|---|---|---|
| 1,503,006 | A * | 7/1924 | Rause | 446/242 |
| 1,639,526 | A * | 8/1927 | Mayer | 446/242 |
| 2,611,995 | A * | 9/1952 | Krapp | 446/242 |
| 3,392,482 | A * | 7/1968 | Nathan | 446/261 |
| 3,803,757 | A * | 4/1974 | Sanchez | 446/242 |
| 4,713,039 | A * | 12/1987 | Wong | 446/233 |
| 5,791,966 | A * | 8/1998 | Capps et al. | 446/242 |
| 6,666,743 | B2 * | 12/2003 | Polare et al. | 446/256 |
| 6,969,296 | B1 * | 11/2005 | Chen | 446/242 |
| 7,037,169 | B2 * | 5/2006 | Benedek et al. | 446/242 |
| 7,175,311 | B2 * | 2/2007 | Chen | 362/253 |
| 2001/0034181 | A1 * | 10/2001 | Bakst | 446/242 |

* cited by examiner

*Primary Examiner* — Gene Kim
*Assistant Examiner* — Scott Young
(74) *Attorney, Agent, or Firm* — Robert E. Goozner

(57) ABSTRACT

A dreidel has a flasher that visually enhances the experience of play. The dreidel can include a rotatable body having four sides, the rotatable body including at least one flashing device; each of the four sides having a transparent or translucent window, each window being marked with a Hebrew letter selected from נ (Nun), ג (Gimel), ה (Hei), ש (Shin) or פ (Pei); and a handle protruding from the rotatable body, the handle being configured to turn the flashing device on and off.

10 Claims, 4 Drawing Sheets

ILLUMINATED DREIDEL

BACKGROUND OF THE INVENTION

1. Field of the Invention

A dreidel or top is equip with flashing lights that can be turned on or off with the handle, or turned on or off automatically while spinning.

2. Description of the Related Art

A dreidel (Yiddish: דריידל dreydl, Hebrew: סביבון Sevivon) is a four-sided top, played with during the Jewish holiday of Hanukkah. The dreidel is used for a gambling game similar to Teetotum. Each side of the dreidel bears a letter of the Hebrew alphabet: נ (Nun), ג (Gimel), ה (Hei), ש (Shin), which together form the acronym for "נס גדול היה שם" (Nes Gadol Haya Sham—"a great miracle happened there"). These letters also form a mnemonic for the rules of a gambling game played with a dreidel: Nun stands for the Yiddish word nisht ("nothing"), Hei stands for halb ("half"), Gimel for gants ("all"), and Shin for shteln ("put"). In the state of Israel, the fourth side of most dreidels is inscribed with the letter פ (Pei), rendering the acronym, נס גדול היה פה, Nes Gadol Haya Po—"A great miracle happened here" referring to the miracle occurring in the land of Israel. Some stores in Hasidic neighborhoods may sell the traditional Shin dreidels.

After lighting the Hanukkah menorah, it is customary in many homes to play the dreidel game: Each player starts out with 10 or 15 coins (real or of chocolate), nuts, raisins, candies other markers, and places one marker in the "pot." The first player spins the dreidel, and depending on which side the dreidel falls on, either wins a marker from the pot or gives up part of his stash. The code (based on a Yiddish version of the game) is as follows:

Nun—nisht—"nothing"—nothing happens and the next player spins

Gimel—gants—"all"—the player takes the entire pot

Hey—halb—"half"—the player takes half of the pot, rounding up if there is an odd number Shin—shtel ayn—"put in"—the player puts one marker in the pot.

However, dreidels (and similar top devices of the related art) have drawbacks. Dreidels are usually formed from solid materials like clay or wood. Even if brightly painted, these dreidels may lack the visual excitement that children and adults currently expect from modern toys and gaming devices. Also, people unfamiliar with the Hebrew alphabet may be unable to understand the code.

BRIEF SUMMARY OF THE INVENTION

An object of the invention is to provide a top device or dreidel that overcomes the disadvantages of the related art top devices or dreidels.

The invention, in part, pertains to a spinning device or dreidel that includes a rotatable body having four sides, the rotatable body including at least one flashing device; each of the four sides having a transparent or translucent window; and a handle protruding from the rotatable body.

In the invention, there can be a letter affixed to each of the four sides. The letter can be a Hebrew letter selected from נ (Nun), ג (Gimel), ה (Hei), ש (Shin) or פ (Pei). The handle can be configured to turn the flashing device on or off. The flashing device can include at least one light emitting element, at least one battery and a flasher circuit. The spinning device can further include a pointed end arrange at an end of the spinning device opposite from the handle, and the pointed end can includes a weight.

In the invention, the flashing device can include four lamps arranged so that each lamp corresponds to one of the four sides of the flashing device, and each of the four lamps has a different color from the others. The flashing device can include a position sensor configured to flash only the lamp corresponding to the side facing upward when a play is over and the spinning device is at rest.

The invention, in part, pertains to dreidel that includes a rotatable body having four sides, the rotatable body including at least one flashing device; each of the four sides having a transparent or translucent window, each window being marked with a Hebrew letter selected from the group consisting of נ (Nun), ג (Gimel), ה (Hei), ש (Shin) and פ (Pei); and a handle protruding from the rotatable body, the handle being configured to turn the flashing device on and off.

It is to be understood that both the foregoing general description and the following detailed description are exemplary and explanatory and are intended to provide further explanation of the invention as claimed.

BRIEF DESCRIPTION OF THE DRAWING FIGURES

The accompanying drawings are included to provide a further understanding of the invention. The drawings illustrate embodiments of the invention and together with the description serve to explain the principles of the embodiments of the invention.

DETAILED DESCRIPTION OF THE PREFERRED EMBODIMENTS

Advantages of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
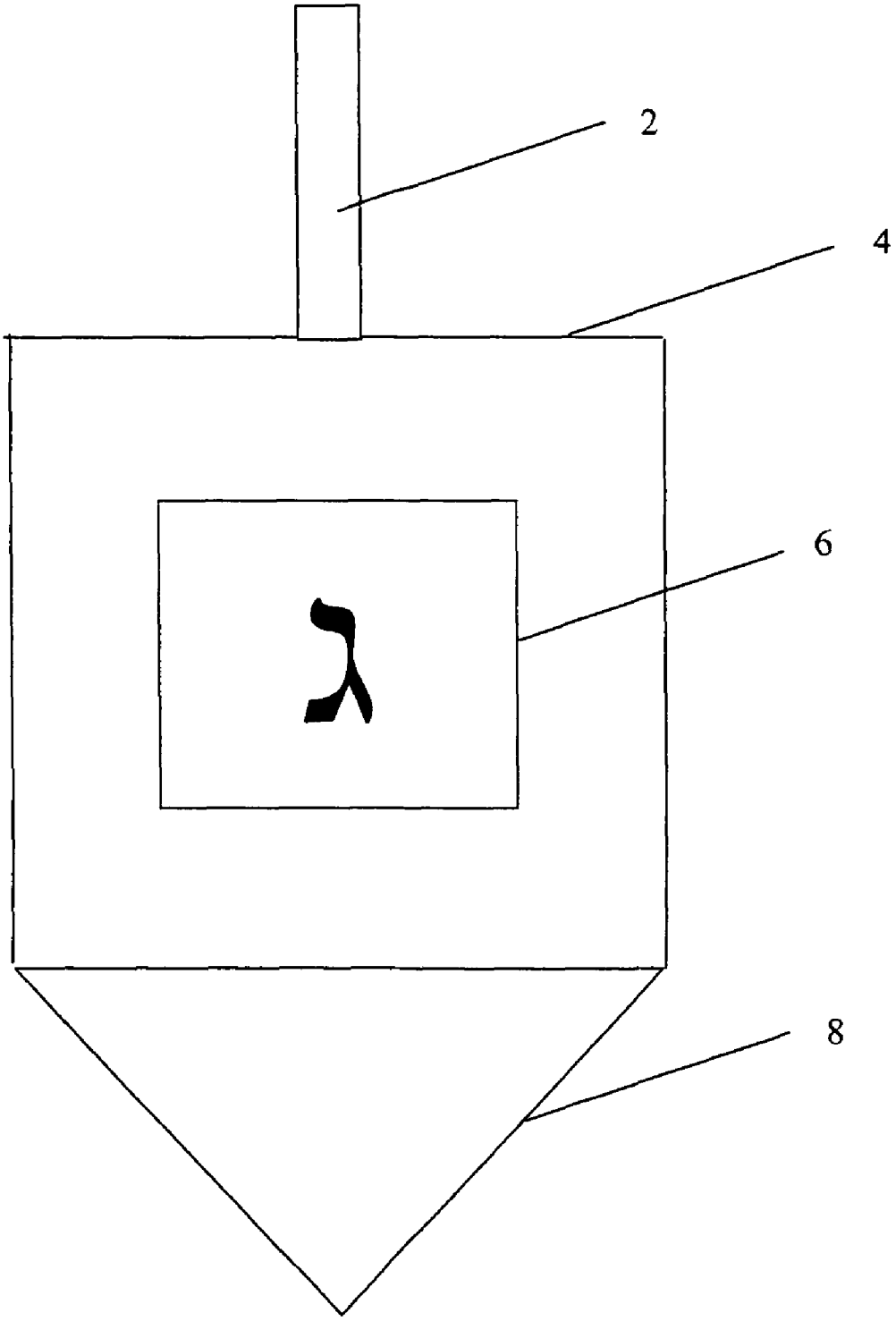
FIG. 1 illustrates a side view of a dreidel having a window of the present invention.

FIG. 1 shows a side view of a dreidel or top according to the present invention. The dreidel includes a handle 2, a body 4 and a pointed end 8 distal from the handle. The dreidel includes a window 6 on each of four sides. The window 6 is formed from a transparent or translucent material such as clear glass, stained glass, clear plastic or colored plastic. The plastic can be any suitable plastic such as polyethylene, polypropylene, polycarbonate, etc. Commercial products such as PLEXIGLASS or FLEXOGLAS can be used. The body 4 of the dreidel can be made from any suitable material such as clay, wood, glass, ceramic, metal, plastic, etc. The pointed end 8 can be weighted, i.e., contain a weight, so as to stabilize the dreidel.

Figure 2:
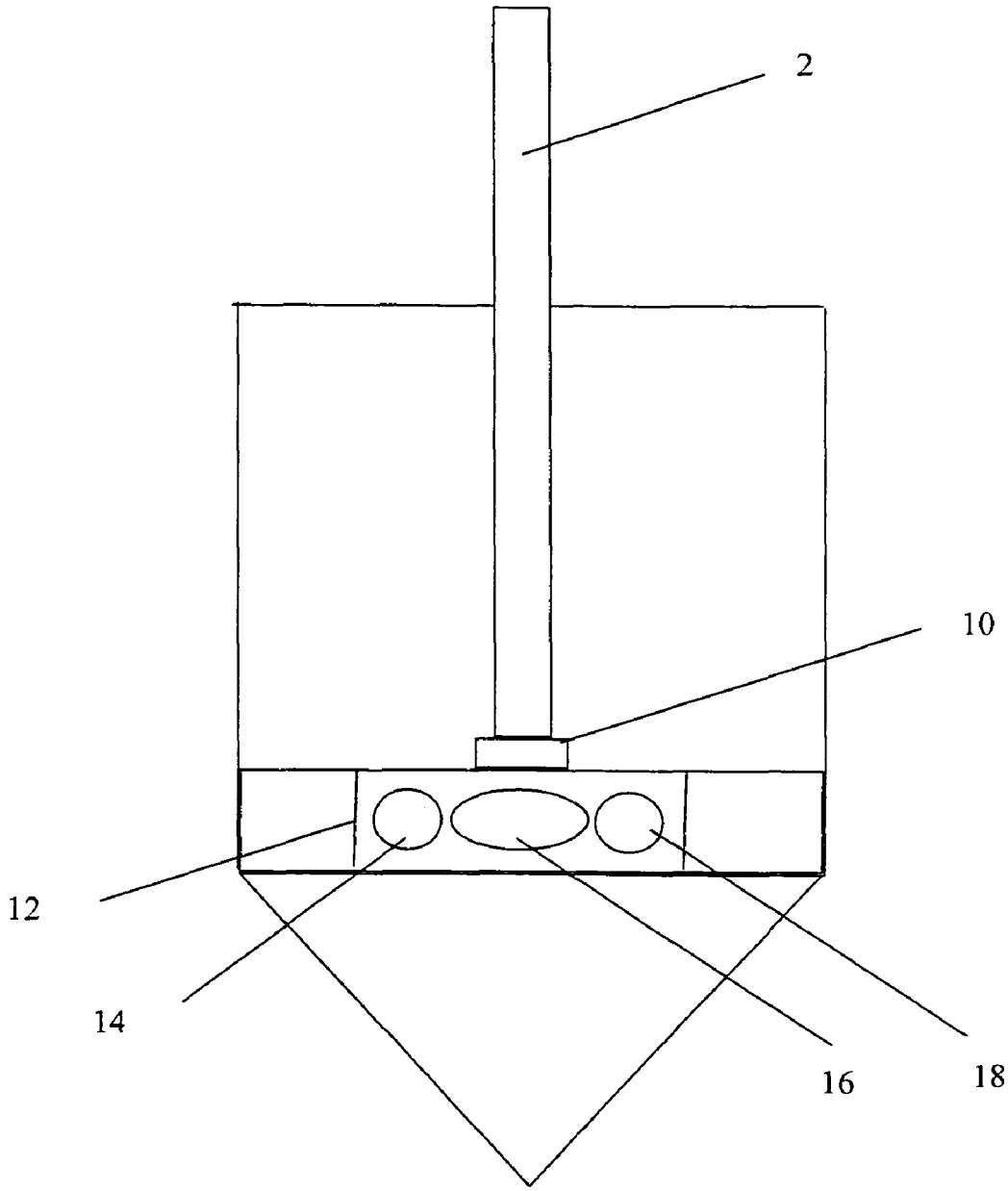
FIG. 2 illustrates a cross sectional view of a dreidel of the present invention.

FIG. 2 is a cross sectional view of the dreidel. The handle 2 projects through the body of the dreidel to contact a switch 10 of an electronic flasher 12. The switch can be a pushbutton type switch such that pressing downward on the handle 2 turns on the electronic flasher 12 and a second pressing downward on the handle 2 turns off the flasher. The handle 2 can be connected to the switch 10 with, e.g., an adhesive. The handle 2 can alternately not be connected to the switch 10, but be configured to contact the switch 10 to turn the electronic flasher on and off. Another configuration would be to have the handle 2 attached to the switch 10 so that pushing down turns the flasher 12 on and pulling up the handle 2 turns the flasher 12 off, and vice versa.

The flasher 12 includes at least one battery 14, an electronic flashing circuit 16 and at least one lamp 18. The lamp 18 can be a conventional light bulb type of light. Preferably, the lamp 18 is a light emitting diode (LED). The LED can be any color such as white, red, blue, green yellow, etc. When more than one LED is used, different colors can be utilized. For example, traditional colors such as blue and white can be used. In one embodiment, the colors blue and white can flash alternately.

There can be more than one battery 12 in the flasher 12 so as to provide brightness and long life. The batteries can typically be button cell type batteries. Examples of button cells include alkaline, lithium, mercury oxide and silver oxide cells. Frequently, two batteries are used. In another embodiment, four batteries are used so that they can be symmetrically arranged to help balance the dreidel.

Figure 3:
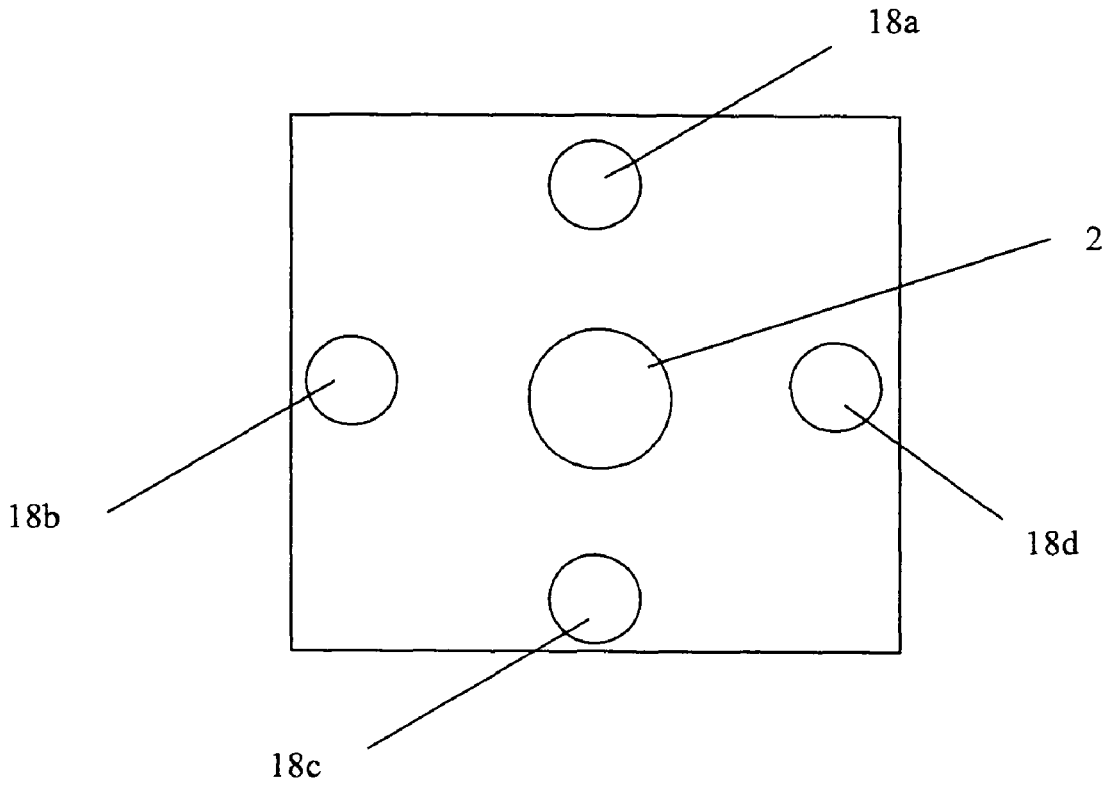
FIG. 3 illustrates an overhead view of a dreidel of the present invention showing an individual light for each side.

FIG. 3 shows an overhead view of a dreidel according to a preferred embodiment of the present invention. The handle 2 is inserted in the top of the dreidel so as to be aligned with the spinning axis. Four lamps (preferably LEDs) 18*a*, 18*b*, 18*c* and 18*d* are arranged so that each is associated with one of the four sides of the dreidel. Each of the four lamps 18*a*, 18*b*, 18*c* and 18*d* can have a different color. In this configuration, at the end of play, the dreidel will lie on its side such that a specific color is facing up and flashing. The color, being associated with a specific Hebrew letter, will readily inform the players and onlookers of the results of the play. The electronic flasher 12 can also have a position sensor so that only a single color, corresponding to Hebrew letter facing up, flashes at the end of the play.

Figure 4:
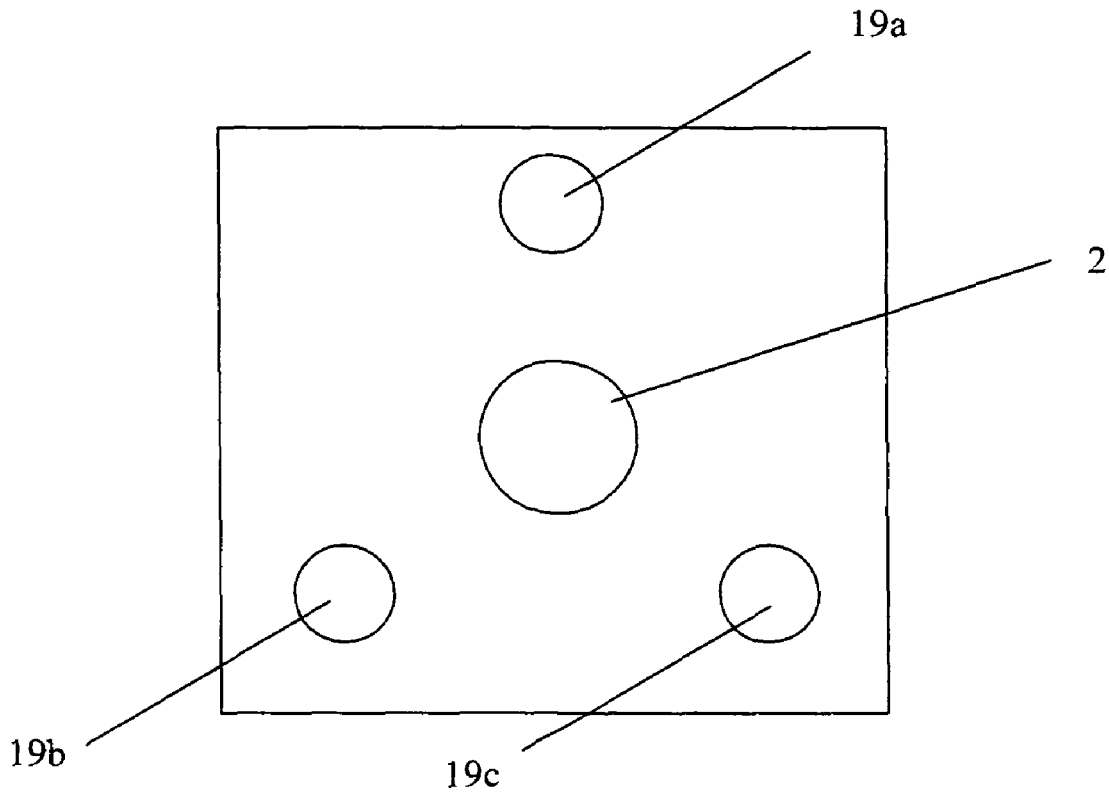
FIG. 4 illustrates an overhead view of a dreidel of the present invention showing an arrangement of three lights.

FIG. 4 shows an overhead view of a dreidel according to another preferred embodiment of the present invention. The handle 2 is inserted in the top of the dreidel so as to be aligned with the spinning axis. Three lamps (preferably LEDs) 19*a*, 19*b*, and 19*c* are arranged so as to provide uniform illumination. The lamps can be arranged in either a symmetric or asymmetric pattern. Each of the three lamps 19*a*, 19*b*, and 19*c* can have a different color. In this configuration, at the end of play, the dreidel will lie on its side such that a different range of hues (depending upon the arrangement of the three lamps) will face upward. The hue, i.e., mix of colors, being associated with a specific Hebrew letter, will readily inform the players and onlookers of the results of the play. The electronic flasher 12 can also have a position sensor so that only a single color flashes at the end of the play.

Also, the dreidel may have a motion sensor so that it may be turned on or off automatically during play, when the device senses motion, i.e., spinning. The motion sensor can be in addition to the handle that turns the dreidel and off. On the other hand, the motion sensor can be used instead of the handle to turn the dreidel on an off.

The dreidel can also include other devices to enhance enjoyment. These devices can include musical devices, aroma generating devices, buzzers, whistles, etc.

It is to be understood that the foregoing descriptions and specific embodiments shown herein are merely illustrative of the best mode of the invention and the principles thereof, and that modifications and additions may be easily made by those skilled in the art without departing for the spirit and scope of the invention, which is therefore understood to be limited only by the scope of the appended claims.

What is claimed is:

1. A dreidel, comprising:

a rotatable body having four sides, the rotatable body including at least one flashing device;

each of the four sides having a transparent or translucent window, each window being marked with a Hebrew letter selected from the group consisting of נ (Nun), ג (Gimel), ה (Hei), ש (Shin), and פ (Pei); and a handle protruding from the rotatable body, the handle being configured to turn the flashing device on and off, the handle projecting through the body to contact a switch of the at least one flashing device, such that a first pressing downward on the handle turns on the at least one flashing device and a second pressing downward on the handle turns off the at least one flashing device.

2. The dreidel according to claim 1, wherein the flashing device comprises at least one light emitting element, at least one battery and a flasher circuit.

3. The dreidel according to claim 1, further comprising a pointed end arrange arranged at an end of the spinning device dreidel opposite from the handle.

4. The dreidel according to claim 3, wherein the pointed end includes a weight.

5. The dreidel according to claim 1, wherein the flashing device includes four lamps arranged so that each lamp corresponds to one of the four sides of the flashing device, and each of the four lamps has a different color from the others.

6. The dreidel according to claim 5, wherein the flashing device includes a position sensor configured to flash only the lamp corresponding to the side facing upward when a play is over and the spinning device is at rest.

7. The dreidel according to claim 1, wherein the flashing device includes four lamps arranged symmetrically or asymmetrically.

8. A dreidel, comprising:

a rotatable body having four sides, the rotatable body including a flashing device, the flashing device including four lamps arranged so that each lamp corresponds to one of four sides of the flashing device, and each of the four lamps has a different color from the others;

each of the four sides having a transparent or translucent window, each window being marked with a Hebrew letter selected from the group consisting of: נ (Nun), ג (Gimel), ה (Hei), ש (Shin) and פ (Pei);

a handle protruding from the rotatable body, the handle being configured to turn the flashing device on and off, the handle projecting through the body to contact a switch of the flashing device, such that such that a first pressing downward on the handle turns on the flashing device and a second pressing downward on the handle turns off the flashing device; and a weighted pointed end arrange at an end of the dreidel opposite from the handle, wherein the flashing device includes a position sensor configured to flash only the lamp corresponding to the side facing upward when a play is over and the spinning device is at rest.

9. The dreidel according to claim 8, wherein the flashing device further comprises at least one battery and a flasher circuit.

10. The dreidel according to claim 8, wherein each window is formed from clear or translucent plastic selected from polyethylene polypropylene or polycarbonate.

* * * * *